US005974701A

United States Patent [19]

Busch

[11] Patent Number: 5,974,701

[45] Date of Patent: Nov. 2, 1999

[54] SHOE DONNING ENABLER

[76] Inventor: Virginia G. Busch, 2114 Windemere Dr., Imperial, Mo. 63052

[21] Appl. No.: 09/039,721

[22] Filed: Mar. 16, 1998

[51] Int. Cl.[6] ..... A43B 11/00; A43C 11/00; A47G 25/80

[52] U.S. Cl. ..... 36/138; 36/50.1; 36/56; 223/113; 223/111

[58] Field of Search ..... 36/138, 136, 56, 36/2 R, 50.1; 223/113, 111, 117, 114

[56] References Cited

U.S. PATENT DOCUMENTS

| | | | |
|---|---|---|---|
| 41,087 | 1/1864 | Moore . | |
| 75,702 | 3/1868 | Rice . | |
| 129,175 | 7/1872 | Russell . | |
| 177,396 | 5/1876 | Harris . | |
| 258,154 | 5/1882 | Thomson . | |
| 261,125 | 7/1882 | Belcher . | |
| 282,240 | 7/1883 | Thomson . | |
| 383,500 | 5/1888 | Stewart . | |
| 506,958 | 10/1893 | Walden . | |
| 588,156 | 8/1897 | Lewis . | |
| 669,417 | 3/1901 | Klett . | |
| 814,061 | 3/1906 | Mahoney . | |
| 913,695 | 3/1909 | Carroll . | |
| 944,424 | 12/1909 | Ferry . | |
| 954,061 | 4/1910 | Von Taxis . | |
| 1,049,721 | 1/1913 | Jacobs . | |
| 1,139,144 | 5/1915 | Thomas . | |
| 1,515,086 | 11/1924 | Baluta . | |
| 1,540,810 | 6/1925 | Simon . | |
| 1,560,124 | 11/1925 | Volkey . | |
| 2,416,556 | 2/1947 | Weeks . | |
| 2,939,618 | 6/1960 | Mangels | 233/113 |
| 4,296,558 | 10/1981 | Antonious . | |
| 4,376,344 | 3/1983 | Kimsey . | |
| 4,408,403 | 10/1983 | Martin | 36/115 |
| 5,090,140 | 2/1992 | Sessa | 36/138 |
| 5,230,171 | 7/1993 | Cardaropoli . | |
| 5,353,483 | 10/1994 | Louviere . | |
| 5,412,852 | 5/1995 | Smaragdas | 24/713.6 |
| 5,657,557 | 8/1997 | Hull et al. | 36/58.5 |

*Primary Examiner*—Ted Kavanaugh
*Attorney, Agent, or Firm*—Grace J. Fishel

[57] ABSTRACT

A shoe donning enabler adapted for use with a dressing stick but which can be used without a dressing stick by some patients. The enabler can be attached to an ordinary pair of shoes and may be supplied as a conversion kit. The enabler has a ring supported at the back of a shoe on a lace, a first end of which is attached to the ring and a second end of which is threaded through a pair of holes provided in the back of the shoe. The second end of the lace passes from the inside of the shoe through one of the holes, passing back through the second hole into the inside of the shoe and is attached to the ring. The lace is long enough that the ring hangs outside the shoe where it can be hooked with a dressing stick or finger.

9 Claims, 4 Drawing Sheets

SHOE DONNING ENABLER

BACKGROUND OF THE INVENTION

1. Field of the Invention

The present invention relates to a shoe donning enabler which can be attached to an ordinary pair of shoes and may be supplied as a conversion kit. The enabler is adapted for use with a dressing stick but can be used without a stick by some users.

2. Brief Description of the Prior Art

Most human beings want to be independent insofar as possible. It starts with, "Mommy, I want to do it myself," and continues ever after. Sometimes, however, as a result of injury, disease, age or some combination thereof, it becomes difficult for a person who is disabled by cardiovascular accident (CVA), Parkinson's, total hip replacement, multiple sclerosis, etc. to dress. Dressing hooks as shown in the drawings are commonly used to reach for items, pull up zippers, don pants and so forth. Putting on shoes, however, is still a challenge.

People who are disabled are no less fashion conscious than other people and prefer to wear ordinary, current style clothes and shoes. Cost is also a factor, as special clothing and orthopedic shoes are expensive, in addition to being institutional in appearance.

An individual feels more like a real person if she can dress herself. There have been studies showing that a person's feelings of self-worth have a profound effect on his or her physical health. There have also been studies showing that the elderly are more likely to commit suicide than younger people, probably because of their diminished ability to function independently and decreased number of personal choices, factors which impact the physically disabled irrespective of age.

There are many devices for supporting the back of a shoe while an able bodied person pushes in his or her foot. There are pull tabs, straps and rings for pulling up a pair of boots or for putting on and taking off a pair of overshoes. Insofar as known, none of the above-mentioned devices provides a conversion system for attaching a shoe donning enabler, adapted for use with a dressing stick, to an ordinary pair of shoes. It is to this need, that the present invention is addressed.

BRIEF SUMMARY OF THE INVENTION

In view of the above, it is an object of the present invention to provide a shoe donning enabler that allows a disabled person to independently put on his or her shoes with a dressing stick. It is another object to provide an enabler that allows the patient to take off his or her shoes without assistance from a caregiver. It is a further object to provide an enabler that can be used without a dressing stick by some users. Other objects and features of the invention will be in part apparent and in part pointed out hereinafter.

In accordance with the invention, a shoe donning enabler for attachment to a shoe having a back and a collar has a pair of holes disposed on opposite sides of the center of the back below the collar to avoid chaffing pressure upon an Achilles tendon of a wearer's foot. Enabler also has a ring adapted to be hooked with a dressing stick and a lace having first and second ends. The first end of the lace is attached to the ring and the second end is threaded from the inside of the shoe through one of the holes, passing back through the second hole into the inside of the shoe and attached to the ring. The lace is long enough that the ring hangs outside the shoe below the collar where it can be hooked with the dressing stick or pulled with a finger.

A method of use for the above-mentioned shoe donning enabler with a shoe having a fastening for opening and closing the throat and a tongue has the steps of:

a. a patient hooking the ring with the dressing stick and lifting the shoe into his or her lap;

b. removing the dressing stick from the ring and wedging the tongue in the fastening to open the throat and to eliminate interference with the tongue during insertion of his or her foot;

c. hooking the ring with the dressing stick and lowering the shoe to the floor;

d. with dressing stick in the ring and the dressing stick resting on his or her lap, lifting a leg with one hand to insert his or her foot into shoe;

e. grasping the stick and pulling back on the shoe by the ring to seat his or her foot in the shoe;

f. unhooking the dressing stick and tapping the tongue with the dressing stick to release the tongue wedged in the fastening;

g. hooking the fastening with the dressing stick to close the throat; and, h. repeating steps a–g to insert his or her foot into the other shoe, if necessary, whereupon the patient can set aside dressing stick.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
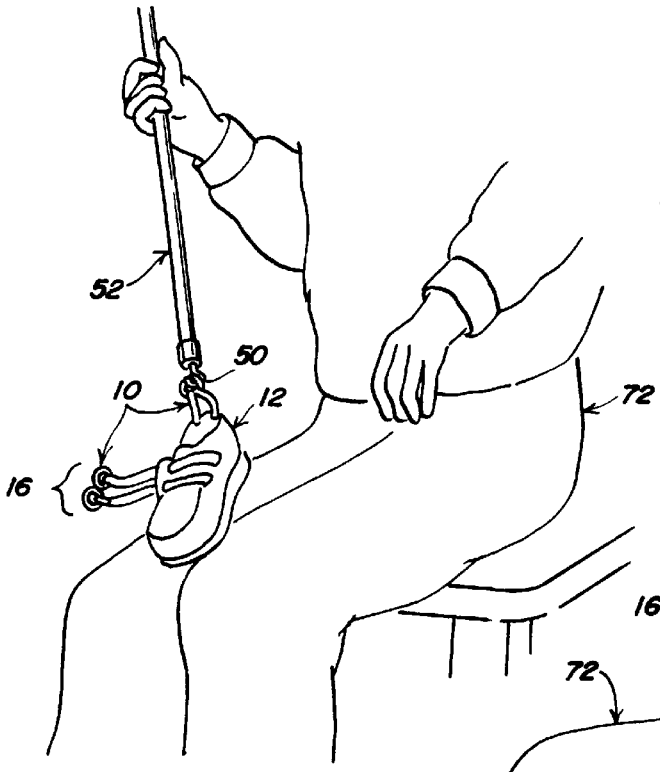
FIGS. 1–6 illustrate a shoe donning enabler in accordance with the present invention in use by a CVA patient paralyzed on the left side putting on a shoe on her left foot.
Figure 2:
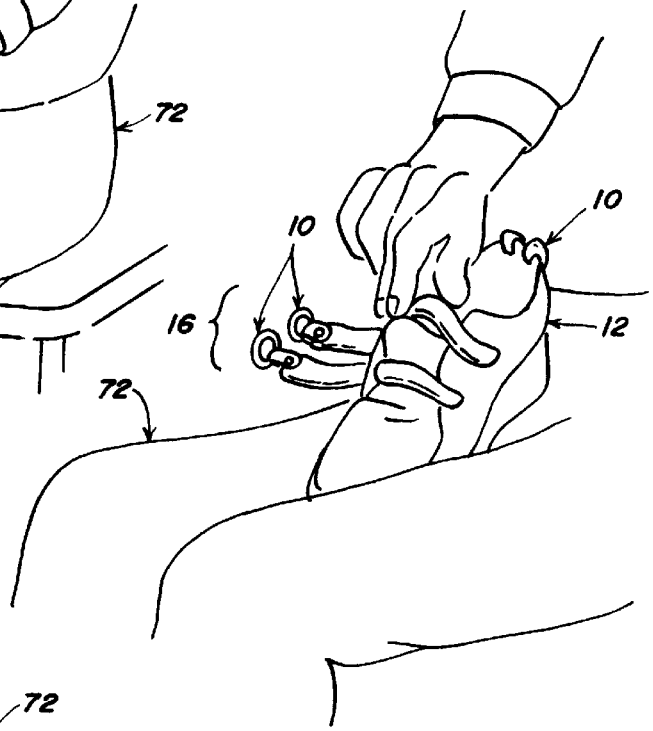
Figure 3:
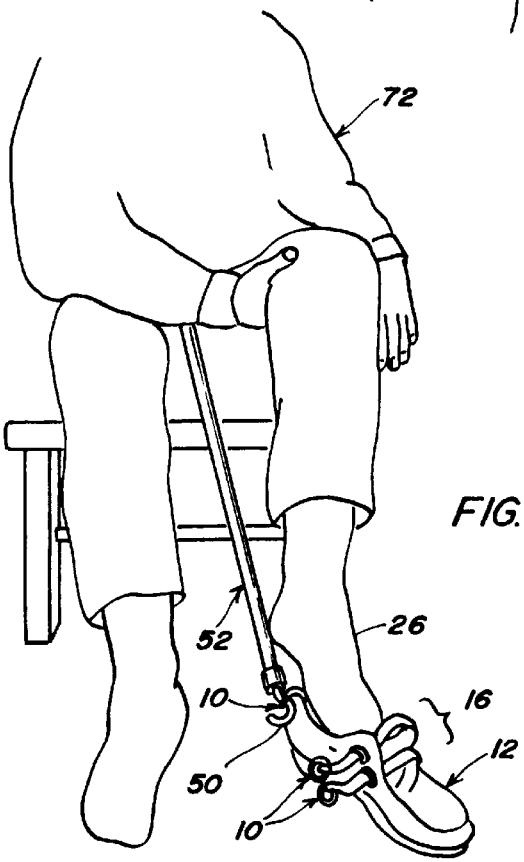

Referring to the drawings more particularly by reference character, reference numeral 10 refers to a shoe donning enabler in accordance with the present invention. Enabler 10 attaches to a shoe 12 with an open throat 14 or one that can be opened by loosening a fastening 16. Shoe 12 is preferably of the low quarter type and has an upper portion 18 and a lower portion 20 with a tongue 21 in throat 14. Upper portion 18 has a first side 22 and an opposing second side 24 which are joined at the front over the instep of a wearer's foot 26 and meet at the rear to form a back 28. A collar 30 is stitched, bonded or otherwise attached around the top of shoe 12 to finish the top edge. Lower portion 20 includes a sole 32, usually defined with a heel 34.

Figure 11:
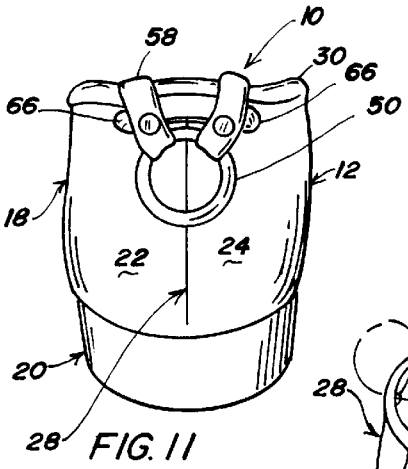
FIG. 11 is a rear view of a shoe donning enabler in accordance with the present invention attached to the shoe.
Figure 10:
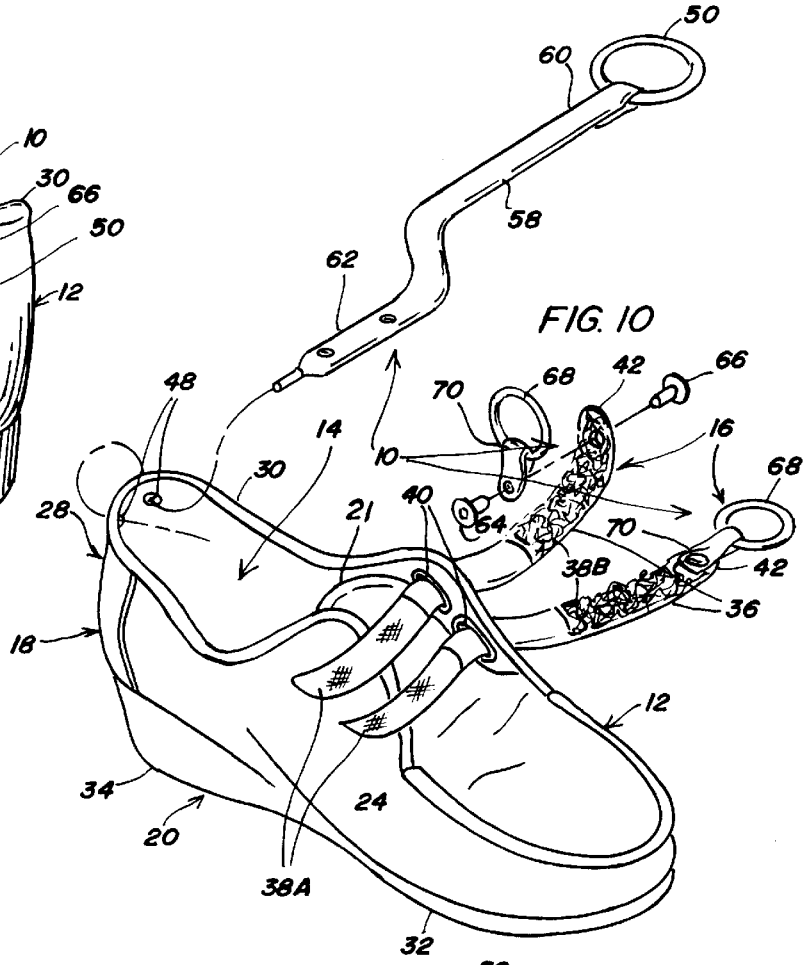
FIG. 10 is an exploded perspective view of the lace with the ring attached being threaded through a pair of holes at the back of the shoe.
Figure 12:
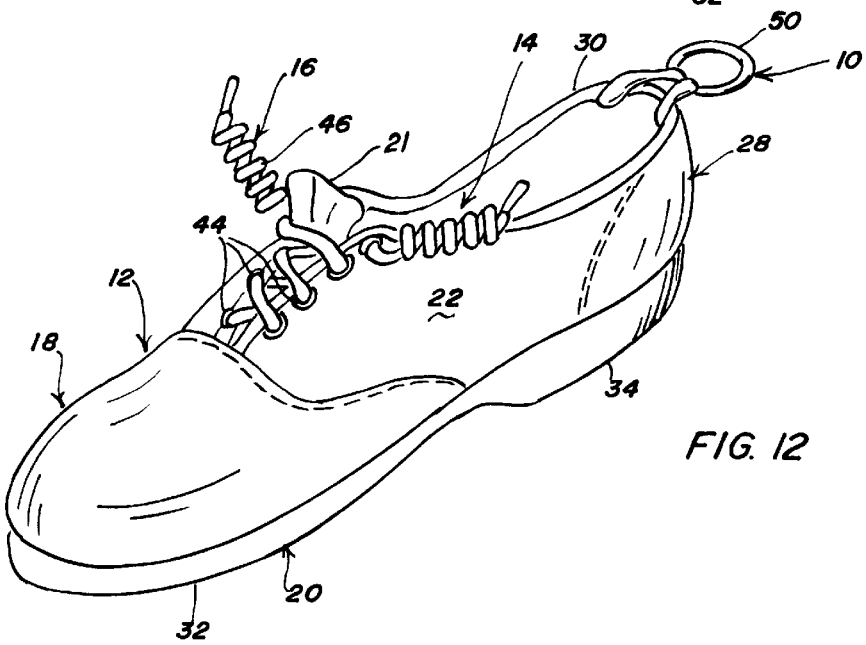
FIG. 12 is a perspective view of a second shoe with a shoe donning enabler attached to the shoe.

As shown in FIGS. 10–11, shoe 12 is an athletic shoe and fastening 16 comprises a pair of straps 36 with mating loop and pile fasteners 38A, 38B (e.g., VELCRO fasteners). One end of straps 36 is attached to one side of throat 14, while the other end is threaded through an aperture 40 provided on the other side of the throat. As will be readily understood, throat 14 can be cinched closed over wearer's foot 26 by pulling a free end 42 of strap 36 through aperture 40 until the desired tightness is obtained. Fastening 16 is then secured by contacting mating fasteners 38A, 38B. The shoe shown in FIG. 12 is of a lace type sport shoe. Fastening 16 comprises two or more eyelets 44 provided on opposite sides of throat 14 and an elastic tie 46. While athletic and sports shoes are shown in FIGS. 10–12, it will be understood that shoe 12 can be a dress shoe. Shoe 12 may also be a slipper with an open throat that is easily slipped on the foot and held without the aid of lacing or other fastening.

Figure 9:
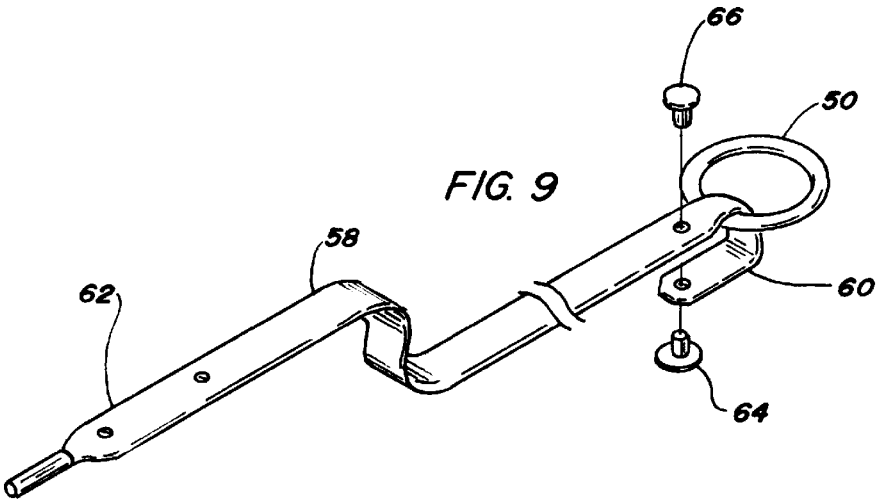
FIG. 9 is an exploded perspective view of a lace with a ring attached to one end.

With continuing reference to FIGS. 10–12 together with FIG. 9, enabler 10 comprises a pair of holes 48 disposed on opposite sides of the center of back 28 below collar 30 to avoid chaffing pressure upon the Achilles tendon of wearer's foot 26. The avoidance of chaffing is very important. If the holes are too close to the center of the back, the lace, which is described below, may cause pressure, discomfort, blistering or decubitus. Holes 48 may be finished with an eyelet when shoes 12 are made of very thin canvas or cloth.

As a second element, enabler 10 includes a ring 50 adapted to be hooked with a dressing stick 52. As shown in FIGS. 1 and 3–8, dressing stick 52 is an elongated member, typically about 36 inches long, with a small C-shaped hook 54 at one end and a larger S-shaped hook at the other, such dressing sticks are in common use by disabled persons to reach for items, pull up zippers, don pants and so forth. While ring 50 is illustrated as round, it will be understood that it may be some other closed form which can be hooked with C-shaped hook 54, these other forms being encompassed within the meaning of "ring" as that term is used in the patent claims.

The third portion of enabler 10 is a lace 58 with first and second ends 60, 62, respectively. Lace 58 is preferably a flat, loose-weave shoestring, whose color may be selected to match or contrast with shoe 12. First end 60 of lace 58 is attached to ring 50. This may be accomplished in a number of different ways, one of which is shown in FIG. 9. Other methods include stitching, fusing, etc. As shown in FIG. 9, first end 60 is passed through ring 50 and folded over. A rivet base 64 with a prong passes through folded lace 58 and is secured with a cap 66. Referring now to FIG. 10, second end 62 of lace 58 is threaded from the inside of shoe 12 through one of holes 48 and then passed back through the second hole 48 into the inside of the shoe as shown in FIG. 10. Second end 62 is then attached to ring 50 in the same manner as first end 60, lace 58 being long enough that ring 50 hangs outside shoe 12 below collar 30, as shown in FIG. 11, where it can be hooked with dressing stick 52. When shoe 12 is an athletic shoe as shown in FIGS. 10–11, additional rings 68 mounted on loops 70 may be attached to free end 42 of straps 36, providing a further element of enabler 10, for use as more particularly described below.

The materials from which enabler 10 may be made are a matter of engineering choice. However, the present invention may be easily manufactured from pre-existing parts, if so desired, a non-limiting example of which follows:

1. Purchase a package of loose-weave shoestrings at least 20" long by ⅜" wide, which is enough to make enablers 10 for a pair of shoes 12, each of which has two straps 36.
2. Measure and cut a 7" piece off the ends of each shoestring, leaving the plastic tips in tact. The remaining 6" of the shoestrings should be cut into 4 individual 1½" pieces for use as more particularly described below.
3. Apply Aileene's "OK to Wash It" fabric glue to the ends of each cut piece. The 7" pieces should have fabric glue applied to 1½" of each end (disregard the plastic tip in the gluing measurement because it will be cut off after installation, but apply fabric glue to that 1½" of the end of that piece also). The 1½" pieces should have fabric glue applied to ½" of each end. Allow glue to dry until it is not messy but still flexible (½ to 1 hour).
4. Measure and make ice pick or awl holes ½" and 1¼" from each end of each 7" piece of shoestring, being careful not to displace strands of the loose-weave shoestring.
5. Insert pronged rivet base 64 into the hole at one end of each 1½" piece so the fabric glue, when dry, will hold it in place.
6. Insert pronged rivet base 64 into the hole ½" from the cut end of the 7" piece of shoestring. Press pronged rivet base 64 into the hole so the fabric glue, when dry will hold it in place. Trim cut ends of the glued shoestring to round them close to the rivet base.
7. Add a ½" brass, stainless steel, plastic, etc. ring 68 to each 1½" piece by folding the shoestring piece over one side of the ring and fitting the hole in the end of the shoestring over the rivet base 64. Press the two layers of shoestring together on the rivet and allow to dry completely. This process encloses the ring and forms loops 70, which are a portion of enabler 10 for the athletic shoes shown in FIGS. 10–11.
8. Add a ¾" brass, stainless steel, plastic, etc. ring 50 to the cut end of each 7" piece of shoestring by encasing the ring between the ½" hole and the 1¼" hole in the shoestring. The ½" hole holds pronged rivet base 64 and inserts into the 1¼" hole in the shoestring. Press the layers together on the rivet and allow to dry completely. This process encloses the ring in a shoestring loop and produces a shoe-loop for the back of a shoe as shown in FIG. 9 for installation as follows.
9. Using a tape measure accurately measure and mark a spot ¾" on either side of the center of back 28 of the shoe.
10. Using a ⅛" leather eyelet punch, make holes 48 at the spots marked in the above step.
11. Insert the plastic tipped end of a 7" shoe-loop into one of the punched holes going from the inside of the shoe, out. Pull the tip through until 1½" of shoestring and ring 50 remains inside the shoe.
12. Lead the plastic tipped end over and into the other hole in the back of the shoe going from the outside of the shoe, in. Pull the tip through to the inside of the shoe just enough to take up the slack on the outside of the shoe but leaving the ring and 1½" of shoestring inside the shoe at the first hole.
13. Bring the tipped end of the shoestring through the ring that is inside the shoe and insert pronged rivet base 64 into the hole just above the plastic tip of the shoestring then through the hole 1¼" from the plastic tip of the shoestring encasing the ring in the loop formed.

14. At this point, make sure ring 50 will hang evenly on the outside of the back of the shoe and that the capped side of the rivet will face out when the ring is flipped to the back of the shoe and also that the prong on the rivet base at the plastic tipped end of the shoe-loop is pointing out, away from the back of the shoe.
15. Position the shoe and shoe-loop formed above to allow two free hands to work with (such as standing the shoe on its back or propping the shoe against something so that it rests on its back).
16. Place an anvil under the uncapped rivet base 64. Place rivet cap 66 on rivet base 64. Apply finger pressure to position the cap. Position a rivet cap setter onto the rivet cap. Secure the cap onto the prong of the rivet base by striking the rivet setter with a hammer several times.
17. Check to see if the rivet and cap are evenly and completely set (as tight as possible against the shoe-loop on both base and cap sides).
18. Measure and mark a spot ¼" from the tips of straps 36 on the shoe.
19. With the ⅛" leather eyelet punch, make holes at the marks.
20. On free end 42 of each strap, position the rivet prong of a small ringed shoe-loop 70 into the punched hole inserting it from the bottom to top of each strap.
21. Lay the shoe on its side and place the anvil under the rivet base, freeing both hands.
22. Place and finger press a rivet cap onto the rivet prong. Position the rivet setter onto the rivet cap and strike the rivet setter several times to set the rivet cap tightly onto the rivet prong.
23. Check to see if the cap and base are as close and tight as possible, as in the large shoe-loop installation.

It will be understood that enabler 10 and the tools needed to install it on a pair of ordinary shoes may be supplied as a kit.

Figure 4:
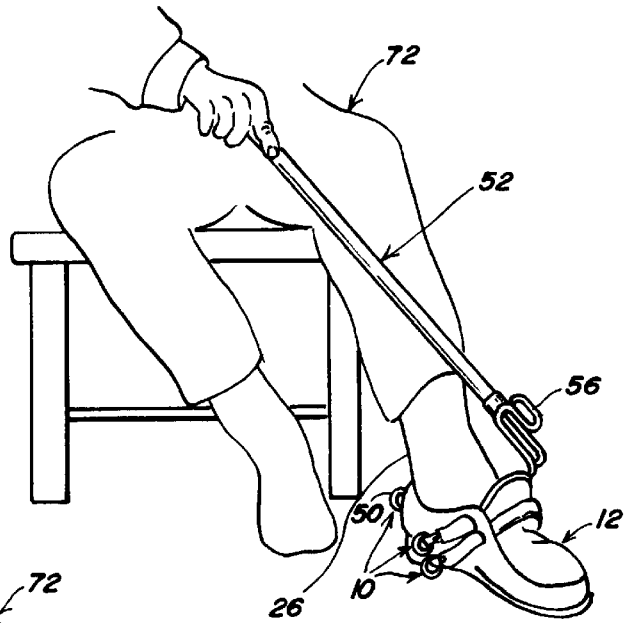
Figure 5:
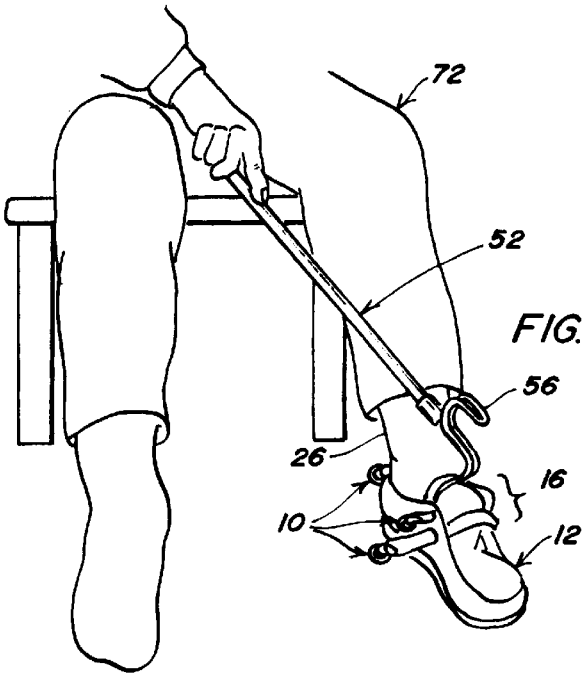
Figure 6:
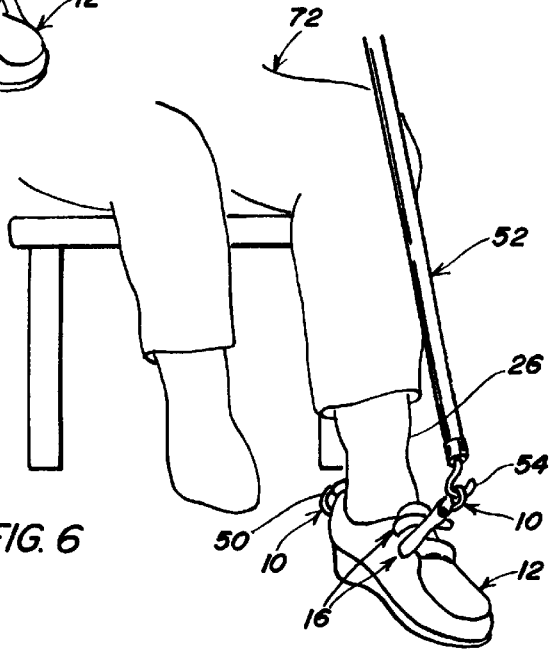

The following is a method teaching the use of enabler 10 by a CVA patient 72 as shown in FIGS. 1–6 for putting on a shoe wherein the patient has been paralyzed on the left side. The method includes the steps of:

a. hooking ring 50 with C-shaped hook 54 on dressing stick 52 and lifting shoe 12 into his or her lap (FIG. 1);
b. removing C-shaped hook 54 from shoe 12 and wedging tongue 21 between first and second straps 36 of shoe 12 as shown in FIGS. 10–11 or between elastic ties 46 of shoe 12 shown in FIG. 12 to open throat 14 and eliminate interference with tongue 21 during insertion of foot 26 (FIG. 2);
c. hooking ring 50 with C-shaped hook 54 and lowering shoe 12 back to the floor;
d. with C-shaped hook in ring 50 and dressing stick 52 on his or her lap, lifting the affected leg with the unaffected hand to insert foot 26 into shoe 12 (FIG. 3);
e. grasping the dressing stick and pulling it back toward himself or herself to set his or her foot in the shoe. If shoe 12 becomes awkwardly positioned during this step, the patient can use his or her unaffected foot to help guide the shoe as it is drawn onto foot 26;
f. unhooking dressing stick 52 and tapping tongue 21 out from between straps 36 or elastic tie 46 with the large S-shaped hook 56 on the opposite end of dressing stick 52 (FIG. 4). If tongue 21 is difficult to dislodge from straps 36 or elastic tie 46, pull fastening with S-shaped hook to loosen (FIG. 5);
g. using C-shaped hook 54, hooking ring 68 on one of straps 36 and pulling the strap across the top of the shoe and closing fastening 16 by engaging loop and pile fasteners (FIG. 6), repeating with the other strap 36. If shoe 12 has a fastening as shown in FIG. 12, elastic tie 46 is tightened by pulling on it with C-shaped hook 54; whereupon the patient has put on shoe 12 and can set aside dressing stick 52.

Figure 7:
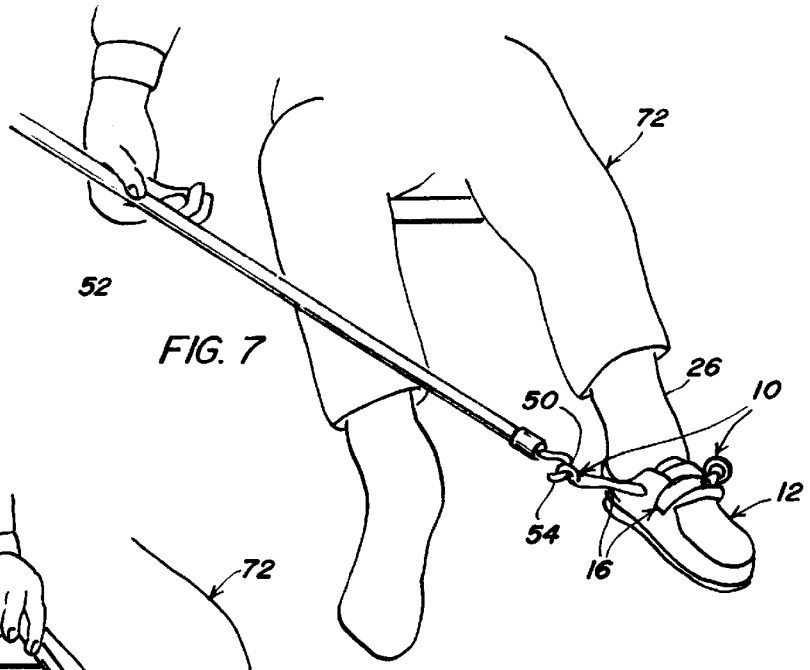
FIGS. 7–8 illustrate the shoe donning enabler in use by the patient taking off the shoe on her left foot.
Figure 8:
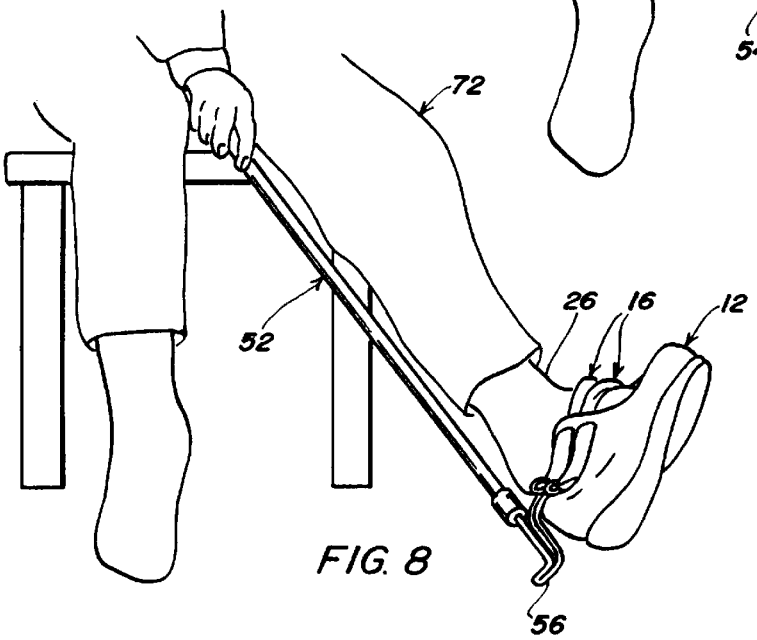

As shown in FIGS. 7–8, enabler 10 can also be used by a CVA patient in a method for taking off a shoe. The method includes the steps of:

a. hooking C-shaped hook 54 into rings 68 and undoing straps 36, one by one (FIG. 7). If fastening 16 is elastic tie 46, loosing ties with C-shaped hook 54; and,
b. hooking S-shaped hook 56 on back 28 of shoe 12 and pushing the shoe off the affected foot 26 with the dressing stick (FIG. 8).

It will be understood by those skilled in the art that the use of enabler 10 is not limited to CVA patients. Enabler 10 can be used by total hip replacement or other hip surgery patients for putting on both shoes, thus avoiding hip flexion past 90 degrees. Enabler 10 can be used by Parkinson's disease patients or people with ataxia or poor coordination who, because of poor balance, might fall if they bend forward while standing or sitting. Lower extremity arthritic patients can also use enabler 10, as can multiple sclerosis, Guillain Barre' syndrome and amyotrophic lateral sclerosis patients, depending on the stage of the disease, extent of the affliction and the individual's limitations. Obese people who have difficulties with hip flexion and people with ankle instability problems will also benefit from use of enabler 10. People with respiratory problems, such as chronic obstructive pulmonary disease (COPD), cardiac patients and post polio syndrome patients who must use energy conservation and work simplification techniques will also find enabler 10 useful, as will paraplegics and spinal cord injury and traumatic brain injury patients, depending on the extent of injury.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A shoe donning enabler comprising a shoe having a back and a collar, a pair of holes disposed on opposite sides of the center of the back below the collar to avoid chaffing pressure upon an Achilles tendon of a wearer's foot, a ring adapted to be hooked with a dressing stick and a lace having first and second ends, said first end attached to the ring, said second end threaded from the inside of the shoe through one of said holes, passing back through the second hole into the inside of the shoe and attached to the ring, said lace being long enough that the ring hangs outside the shoe below the collar where it can be hooked with a dressing stick.

2. The enabler of claim 1 wherein the shoe has an open throat through which a wearer can insert his or her foot.

3. The enabler of claim 1 wherein the shoe has a tongue and a throat that can be opened by loosening a fastening.

4. The enabler of claim 3 wherein the fastening comprises at least one strap with mating loop and pile fasteners, said strap having a first end attached to one side of the throat and a second end passing though an aperture provided on the other side of the throat, said fastening cinched closed by pulling a free end of the strap through the aperture until the desired tightness is obtained and then contacting the mating loop and pile fasteners, said enabler further comprising a loop with a ring on the free end of each strap, said ring adapted to be hooked with a dressing stick for opening and closing the fastening.

5. The enabler of claim 3 wherein the fastening comprises two or more eyelets on opposite sides of the throat through which are threaded an elastic tie.

6. A method of use for a shoe donning enabler comprising a shoe having a back, a collar, a tongue and a throat that can be opened by loosening a fastening, said enabler comprising a pair of holes disposed on opposite sides of the center of the back below the collar to avoid chaffing pressure upon an Achilles tendon of a wearer's foot, a ring adapted to be hooked with a dressing stick and a lace having first and second ends, said first end attached to the ring, said second end threaded from the inside of the shoe through one of said holes, passing back through the second hole into the inside of the shoe and attached to the ring, said lace being long enough that the ring hangs outside the shoe below the collar where it can be hooked with a dressing stick, said method comprising the steps of:

a. a patient hooking the ring with the dressing stick and lifting the shoe into his or her lap;

b. removing the dressing stick from the ring and wedging the tongue in the fastening to open the throat and to eliminate interference with the tongue during insertion of his or her foot;

c. hooking the ring with the dressing stick and lowering the shoe to the floor;

d. with dressing stick resting on his or her lap, lifting a leg with one hand to insert his or her foot into shoe;

e. grasping the dressing stick and pulling back on the ring to seat his or her foot in the shoe;

f. unhooking the dressing stick and tapping the tongue to release the tongue wedged in the fastening;

g. hooking the fastening with the dressing stick to close the throat;

h. repeating steps a–g with his or her other foot, if necessary, whereupon the patient can set aside dressing stick.

7. The method of claim 6 further comprising in step e, using his or her other foot to help guide the shoe as it is drawn onto the foot.

8. The method of claim 6 further comprising in step f, pulling fastening with the dressing stick to help dislodge the tongue.

9. The method of claim 6 wherein the fastening comprises at least one strap with mating loop and pile fasteners, said strap having a first end attached to one side of the throat and a second end passing though an aperture provided on the other side of the throat, said fastening cinched closed by pulling a free end of the strap through the aperture until the desired tightness is obtained and then contacting the mating loop and pile fasteners, said enabler further comprising a loop with a ring on the free end of each strap, said ring adapted to be hooked with a dressing stick for opening and closing the fastening, said method further comprising in step g, pulling each strap across the top of the shoe with the dressing stick in the ring on the strap and then closing the fastening by engaging the loop and pile fasteners.

* * * * *